US009454128B2

(12) United States Patent
Mizutani

(10) Patent No.: US 9,454,128 B2
(45) Date of Patent: Sep. 27, 2016

(54) WASTE TONER STORING CONTAINER, AND IMAGE FORMING APPARATUS INCLUDING WASTE TONER STORING CONTAINER

(71) Applicant: KYOCERA Document Solutions Inc., Osaka-shi, Osaka (JP)

(72) Inventor: Naoki Mizutani, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/921,778

(22) Filed: Oct. 23, 2015

(65) Prior Publication Data

US 2016/0124377 A1 May 5, 2016

(30) Foreign Application Priority Data

Oct. 29, 2014 (JP) ..... 2014-220700

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01); *G03G 2215/0132* (2013.01)

(58) Field of Classification Search
USPC ..... 399/360
See application file for complete search history.

(56) References Cited

U.S. PATENT DOCUMENTS

2005/0002707 A1* 1/2005 Choi ..... G03G 21/105 399/358
2006/0018691 A1* 1/2006 Baek ..... G03G 21/105 399/358
2009/0154972 A1* 6/2009 Tanaka ..... G03G 21/105 399/358
2009/0214262 A1* 8/2009 Jeon ..... G03G 15/0126 399/223
2012/0014728 A1* 1/2012 Karasawa ..... G03G 21/12 399/360

FOREIGN PATENT DOCUMENTS

JP 05313492 A 11/1993

* cited by examiner

*Primary Examiner* — Minh Phan
*Assistant Examiner* — Linda B Smith
(74) *Attorney, Agent, or Firm* — Alleman Hall McCoy Russell & Tuttle LLP

(57) ABSTRACT

A waste toner storing container includes a container main body, a conveyance guide portion, a conveyance portion, a conversion portion, a moving member, and a restriction member. The container main body stores waste toner. The conveyance guide portion has an inclined guide surface that guides the waste toner diagonally downward from a reception port. The conveyance portion is rotatably provided in the inside of the container main body. The conversion portion converts a rotational motion of the rotation shaft to a reciprocating motion in conjunction. The moving member reciprocally moves in a direction along the inclined guide surface by a force of the reciprocating motion received from the conversion portion. The restriction member restricts the moving member from being displaced upward from the inclined guide surface by pressing the moving member toward the inclined guide surface.

12 Claims, 9 Drawing Sheets

WASTE TONER STORING CONTAINER, AND IMAGE FORMING APPARATUS INCLUDING WASTE TONER STORING CONTAINER

INCORPORATION BY REFERENCE

This application is based upon and claims the benefit of priority from the corresponding Japanese Patent Application No. 2014-220700 filed on Oct. 29, 2014, the entire contents of which are incorporated herein by reference.

BACKGROUND

The present disclosure relates to a waste toner storing container for storing waste toner discharged from an image-carrying member, and relates to an image forming apparatus that includes the waste toner storing container.

A cleaning device of an electrophotographic image forming apparatus includes a storing portion for temporarily storing the waste toner. The storing portion is provided with a screw. The waste toner stored in the storing portion is conveyed in one direction and is discharged to outside from a discharge portion of the storing portion. The discharge portion is connected to a waste toner storing portion, and the waste toner discharged from the discharge portion flows into a waste toner storing container and is stored therein.

Meanwhile, a color image forming apparatus that includes a plurality of photoconductor drums includes a plurality of cleaning devices. In addition, the color image forming apparatus includes an intermediate transfer belt (image-carrying member) configured to carry a color toner image which is formed from toner images of a plurality of colors transferred from the photoconductor drums. The color toner image is transferred from the intermediate transfer belt to a recording medium by a transfer device. At this time, toner thas has not been transferred to the recording medium remains on a surface of the intermediate transfer belt, too. As a result, the color image forming apparatus includes a cleaning device for removing the toner that has remained on the intermediate transfer belt. The waste toner removed by the cleaning device is also stored in the waste toner storing container.

In this type of image forming apparatus, the waste toner that has flowed into a connection portion of the waste toner storing container passes through a conveyance guide provided in the waste toner storing container, and then is stored in a storage space that is provided in an inside of the waste toner storing container. In this configuration, the waste toner may stagnate halfway through the conveyance guide. To solve the stagnation, the waste toner storing container may be provided with a plate member for scraping loose the waste toner that has stagnated in the conveyance guide. As the plate member is operated, the stagnated waste toner is scraped off into the storage space.

SUMMARY

A waste toner storing container according to an aspect of the present disclosure includes a container main body, a conveyance guide portion, a conveyance portion, a conversion portion, a moving member, and a restriction member. The container main body stores waste toner discharged from an image-carrying member provided in an image forming apparatus. The conveyance guide portion is disposed in the container main body and has an inclined guide surface that guides the waste toner diagonally downward from a reception port which receives the waste toner, to an inside of the container main body. The conveyance portion is rotatably provided in the inside of the container main body and, by being rotated, conveys the waste toner in a direction along a rotation axis line. The conversion portion is disposed on a rotation shaft of the conveyance portion and converts a rotational motion of the rotation shaft to a reciprocating motion in conjunction with a rotation of the rotation shaft. One end part of the moving member is connected to the conversion portion and the other end part thereof extends through the conveyance guide portion toward the reception port. The moving member reciprocally moves in a direction along the inclined guide surface by a force of the reciprocating motion received from the conversion portion. The restriction member restricts the moving member from being displaced upward from the inclined guide surface by pressing the moving member toward the inclined guide surface in such a manner that the other end part of the moving member abuts on the inclined guide surface.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of an image forming apparatus according to the present disclosure with reference to the attached drawings. It should be noted that the embodiment described in the following is an example of a specific embodiment of the present disclosure and should not limit the technical scope of the present disclosure.

Figure 1:
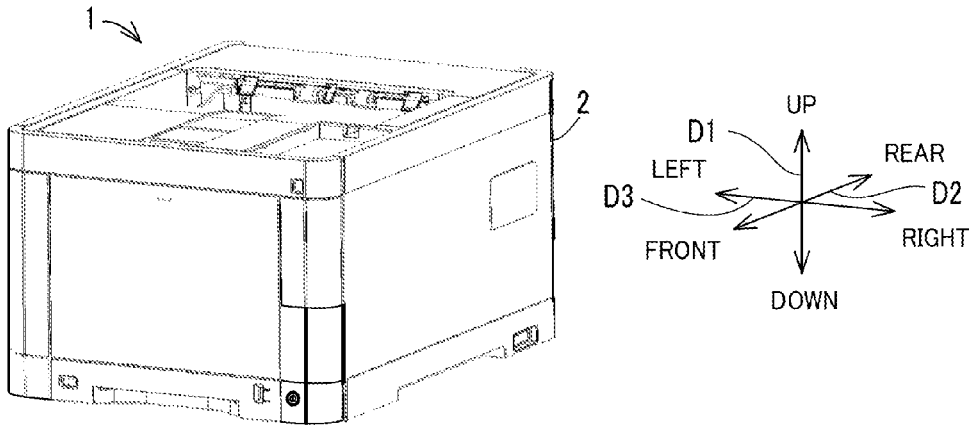
FIG. 1 is a diagram showing a configuration of an image forming apparatus according to an embodiment of the present disclosure.

It is noted that the present embodiment is described using an up-down direction D1, a front-rear direction D2, and a left-right direction D3 that are defined in FIG. 1 based on the normal use state of an image forming apparatus 1.

Figure 2:
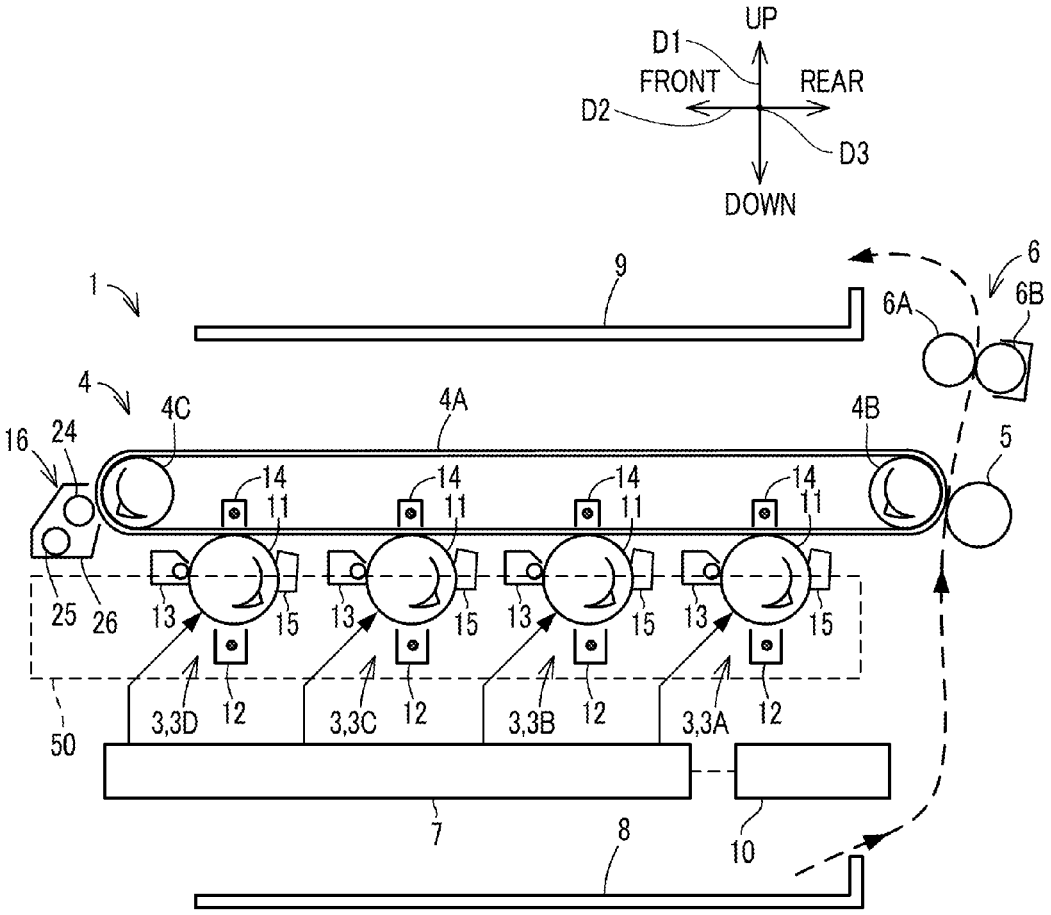
FIG. 2 is a diagram showing an internal configuration of the image forming apparatus of FIG. 1.

The image forming apparatus 1 is a so-called tandem color printer. As shown in FIG. 1, the image forming apparatus 1 includes a housing 2 that includes a cover of an external frame and an internal frame. In addition, as shown in FIG. 2, the image forming apparatus 1 includes a plurality of image forming portions 3, an intermediate transfer unit 4, a secondary transfer device 5, a fixing device 6, an exposure device 7, a sheet feed portion 8, a sheet discharge portion 9, a control portion 10, a belt cleaning device 16 (an example of the waste toner removing portion of the present disclosure), and a waste toner storing container 50.

The plurality of image forming portions 3 (3A-3D) are arranged in alignment in the front-rear direction D2. The plurality of image forming portions 3 respectively form toner images of different colors. In FIG. 2, the image forming portion 3A that is positioned in the most rear side forms a toner image by black toner. The image forming portion 3B, the second from the rear, forms a toner image by yellow toner. The image forming portion 3C, the third from the rear, forms a toner image by cyan toner. And the image forming portion 3D that is positioned in the most front side forms a toner image by magenta toner. Each of the image forming portions 3 includes a photoconductor drum 11, a charging device 12, a developing device 13, a primary transfer device 14, and a drum cleaning device 15. As a result, the image forming apparatus 1 includes a plurality of photoconductor drums 11, a plurality of developing devices 13, and a plurality of drum cleaning devices 15.

The intermediate transfer unit 4 includes an intermediate transfer belt 4A (an example of the image-carrying member of the present disclosure), a driving roller 4B, and a driven roller 4C. The intermediate transfer belt 4A carries a toner image that is formed from toner images of a plurality of (in the present embodiment, four) colors. Supported by the driving roller 4B and the driven roller 4C so as to be rotationally driven, the intermediate transfer belt 4A can move (run) in the state where its surface is in contact with the surfaces of the photoconductor drums 11. When the intermediate transfer belt 4A is rotationally driven, its surface passes through between the photoconductor drums 11 and the primary transfer devices 14. At that time, the toner images of respective colors are transferred in sequence from the photoconductor drums 11 to the surface of the intermediate transfer belt 4A in such a way as to be overlaid with each other.

The secondary transfer device 5 transfers the toner image transferred on the intermediate transfer belt 4A, to a print sheet that is conveyed from the sheet feed portion 8. The print sheet with the toner image transferred thereon is conveyed to the fixing device 6. The fixing device 6 includes a heating roller 6A and a pressure roller 6B. The fixing device 6 conveys the print sheet with the toner image transferred thereon while applying heat and pressure thereto. This allows the toner image to be fused and fixed to the print sheet. The print sheet with the toner image fixed thereto is further conveyed toward the downstream side, and then discharged onto and held by the tray-like sheet discharge portion 9 disposed in the upper part of the intermediate transfer unit 4.

The belt cleaning device 16 is disposed in front of the intermediate transfer unit 4. The belt cleaning device 16 includes a cleaning roller 24, a screw member 25, and a toner box 26, wherein the cleaning roller 24 is a cleaning member. The cleaning roller 24 is disposed to face the driven roller 4C, and its surface is in contact with the intermediate transfer belt 4A. The cleaning roller 24 is rotatably supported in the toner box 26. The cleaning roller 24 rotates when a rotation driving force is input to the spindle of the cleaning roller 24. The cleaning roller 24 has approximately the same length as the intermediate transfer belt 4A. The cleaning roller 24 removes toner that has remained on the surface of the intermediate transfer belt 4A after the transfer of the toner image by the secondary transfer device 5, by being rotated while contacting the intermediate transfer belt 4A. The removed toner (hereinafter referred to as "waste toner") is taken into the toner box 26 by the action of gravity or by the rotation of the cleaning roller 24. The waste toner taken into the toner box 26 is conveyed by the screw member 25. A discharge port 27 (see FIG. 4) is formed on the bottom of the toner box 26 in a right end portion thereof. The screw member 25 has helical blades around a cylindrical shaft member. Upon receiving the action of the blades while the screw member 25 is rotated, the waste toner is conveyed in the toner box 26 toward the discharge port 27. The waste toner is then discharged from the discharge port 27 to the outside. That is, the toner that has remained on the surface of the intermediate transfer belt 4A is removed by the belt cleaning device 16 and is discharged, as the waste toner, from the intermediate transfer belt 4A.

The plurality of image forming portions 3 have the same configuration except that they use toners of different colors respectively.

Each of the photoconductor drums 11 is a cylindrical rotation member with a photosensitive layer formed on its surface. The photoconductor drum 11 is rotatably supported in the housing 2, and rotates in a predetermined direction upon input of a rotation driving force. A toner image of a corresponding color is held on the surface of the photoconductor drum 11. Specifically, when the exposure device 7 exposes the surface of the photoconductor drum 11 to light in the state where the surface of the photoconductor drum 11 has been charged to a predetermined potential by the charging device 12, an electrostatic latent image is formed on the surface of the photoconductor drum 11. The electrostatic latent image is developed by the developing device 13 that is described below. This allows a toner image to be held on the surface of the photoconductor drum 11. The toner image on the photoconductor drum 11 is transferred onto the intermediate transfer belt 4A by the primary transfer device 14.

Figure 3:
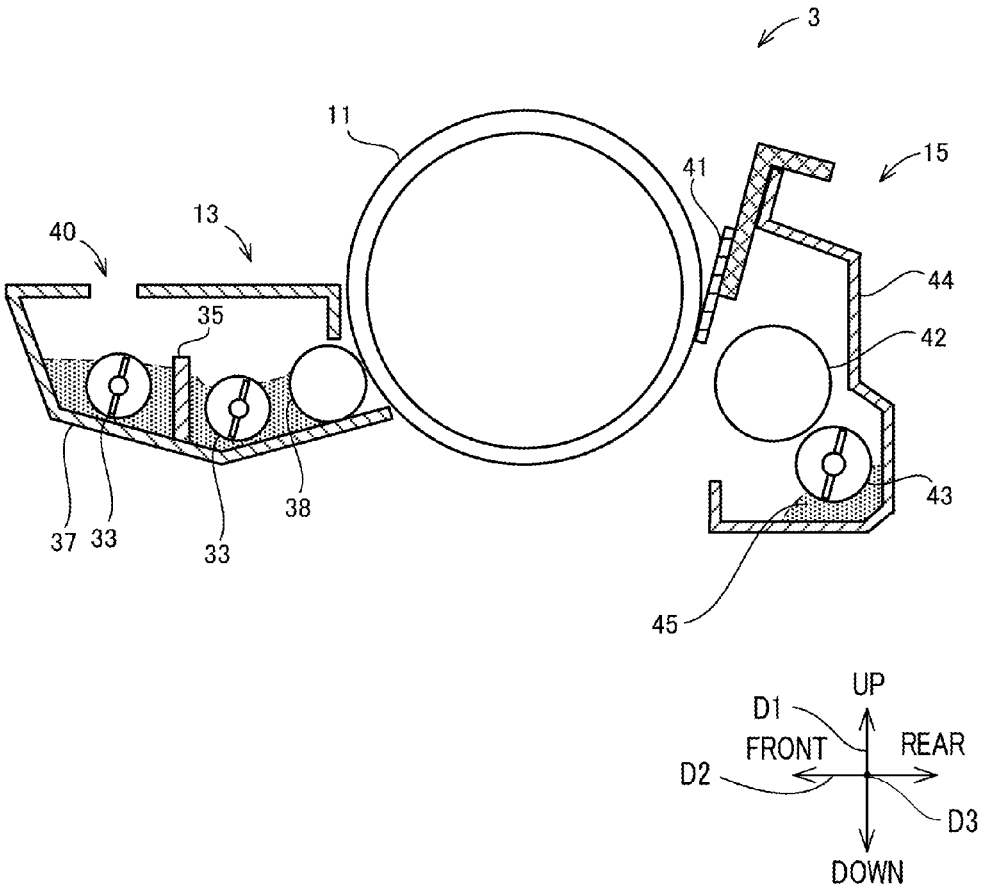
FIG. 3 is a diagram showing a configuration of an image forming portion included in the image forming apparatus of FIG. 1.

As shown in FIG. 3, each of the developing devices 13 visualizes, by developer, the electrostatic latent image formed on the surface of the photoconductor drum 11. The developing device 13 includes a developer case 37 and a magnet roller 38. The developer case 37 stores the developer that includes the toner. The magnet roller 38 is used for development and is rotatably supported in the developer case 37. A bias having the same polarity as the charging polarity of the photoconductor drum 11 is applied to the magnet roller 38. A stirring screw (not shown) is provided in the developer case 37. With the rotation of the stirring screw, the developer is stirred and the toner is charged to a predetermined potential. In addition, the charged toner is conveyed to a position that faces the photoconductor drum 11, and at the position, the toner is caused to fly toward the electrostatic latent image on the surface of the photoconductor drum 11. This allows the electrostatic latent image on the surface of the photoconductor drum 11 to be developed. The developer case 37 has a toner replenishing port 40, and the toner is replenished to the developer case 37 via the toner replenishing port 40 from a toner container (not shown).

Figure 4:
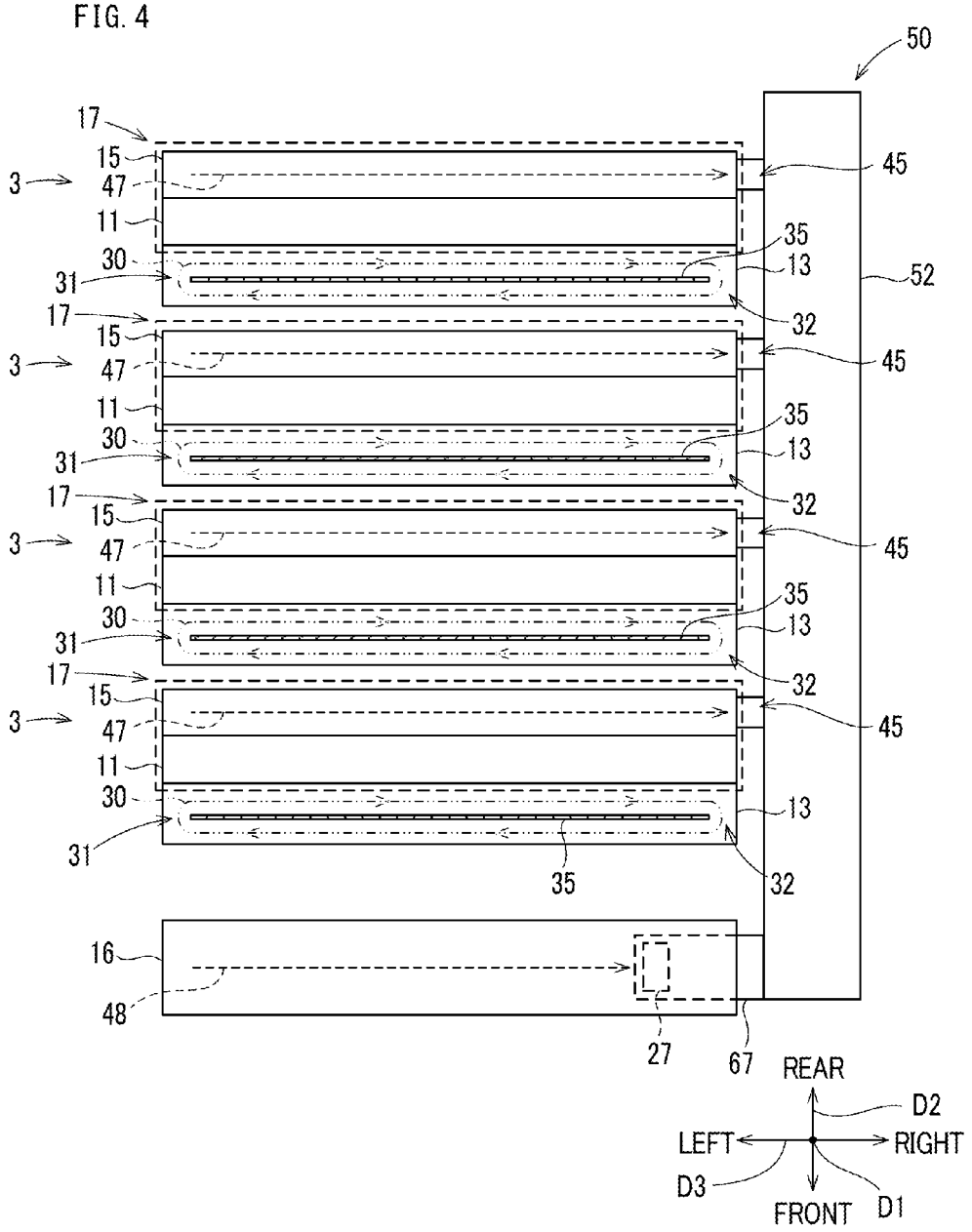
FIG. 4 is a diagram for explaining a toner flow path in which waste toner that has been removed from photoconductor drums and an intermediate transfer belt by cleaning devices flows before flowing into a waste toner storing container.

As shown in FIG. 4, the developer case 37 of the developing device 13 includes a partition wall 35. The partition wall 35 is erected on a bottom of the developer case 37 to extend along the longitudinal direction of the developer case 37 (a direction that matches the left-right direction D3). The inner space of the developer case 37 is partitioned into two spaces by the partition wall 35. The two spaces communicate with each other via communication portions 31 and 32 that are provided at opposite ends thereof in the longitudinal direction. In addition, the two spaces are each provided with a screw member 33 (see FIG. 3) that conveys the developer while stirring it. With the rotation of the screw members 33, the developer in the developer case 37 is conveyed to circulate in the two spaces along a circulation path 30 (see the two-dotted line in FIG. 4).

The drum cleaning device 15 is disposed in the rear side of the photoconductor drum 11. The drum cleaning device 15 is disposed for each of the photoconductor drums 11. The drum cleaning device 15 includes a cleaning blade 41 that is a cleaning member, a cleaning roller 42, a screw member 43, and a toner box 44. The cleaning blade 41 and the cleaning roller 42 have approximately the same length as the photoconductor drum 11. The edge of the cleaning blade 41 is disposed to be in contact with or close to the surface of the photoconductor drum 11. The cleaning roller 42 is rotatably supported in the toner box 44. The cleaning roller 42 rotates when a rotation driving force is input to the spindle of the cleaning roller 42. When the photoconductor drum 11 is rotated, the cleaning blade 41 removes toner that has remained on the surface of the photoconductor drum 11 after the transfer of toner image by the primary transfer device 14. The removed toner (hereinafter referred to as "waste toner") is taken into the toner box 44 by the action of gravity or by the rotation of the cleaning roller 42. The waste toner taken into the toner box 44 is conveyed by the screw member 43 in a discharge direction as indicated by the arrow 47 in FIG. 4. A discharge port 45 (see FIG. 4) is formed in the right-end side wall of the toner box 44. The screw member 43 has helical blades around a cylindrical shaft member. Upon receiving the action of the blades while the screw member 43 is rotated, the waste toner is conveyed in the toner box 44 toward the discharge port 45. The waste toner is then discharged from the discharge port 45 to the outside. That is, the toner that has remained on the surface of the photoconductor drum 11 is removed by the drum cleaning device 15 and is discharged, as the waste toner, from the photoconductor drum 11.

Each pair of the photoconductor drum 11 and the drum cleaning device 15 is unitized as a drum unit 17 (see FIG. 4). The discharge ports 45 included in the drum cleaning devices 15 project respectively from housings (not shown) of the drum units 17 to outside and are connected to reception ports 65 (65A-65D) of the waste toner storing container 50 that is described below.

As shown in FIG. 4, the waste toner removed by the drum cleaning device 15 is conveyed by the screw member 43 in the discharge direction (see the arrow 47) which is oriented rightward in the left-right direction D3 of the image forming apparatus 1. The waste toner that has been conveyed and arrived at the right end of the toner box 44 passes through the discharge ports 45 and the reception ports 65 (65A-65D) of the waste toner storing container 50, and is discharged into a container main body 52 that is described below.

In addition, the waste toner removed from the intermediate transfer belt 4A by the belt cleaning device 16 is conveyed by the screw member 25 in the discharge direction (see the arrow 48) which is oriented rightward in the left-right direction D3 of the image forming apparatus 1. The waste toner that has been conveyed and arrived at the right end of the toner box 26 passes through the discharge port 27 that is provided in the bottom of the toner box 26, passes through a reception port 65 (65E) of the waste toner storing container 50, and is discharged into the container main body 52 that is described below.

The waste toner storing container 50 is provided in the housing 2. As shown in FIG. 2, the waste toner storing container 50 is disposed below the intermediate transfer belt 4A. In addition, as shown in FIG. 4, the waste toner storing container 50 is disposed more on the right side than the right ends of the drum cleaning devices 15 and the belt cleaning device 16.

Figure 5:
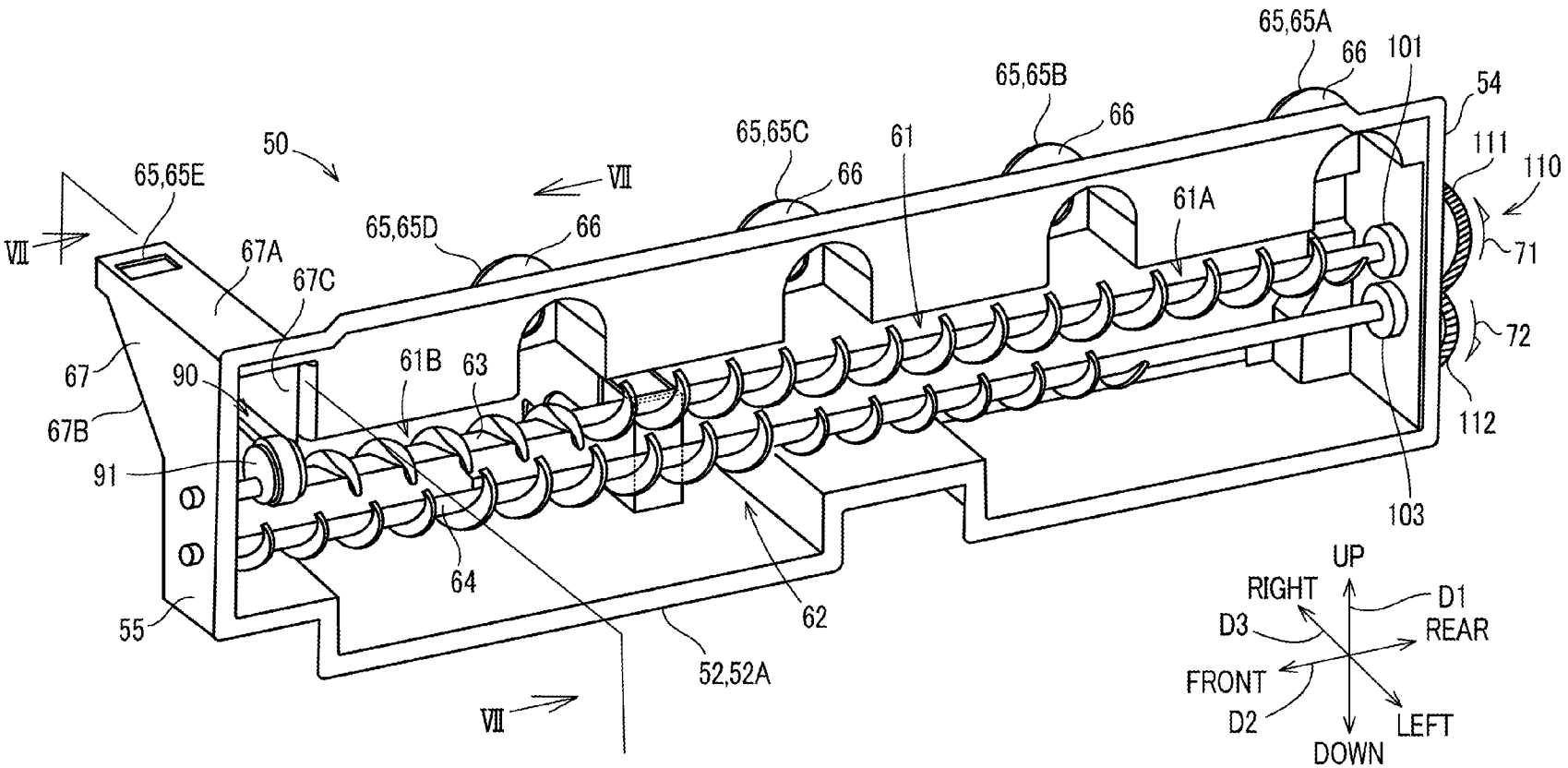
FIG. 5 is a diagram showing a configuration of the waste toner storing container according to an embodiment of the present disclosure.
Figure 6:
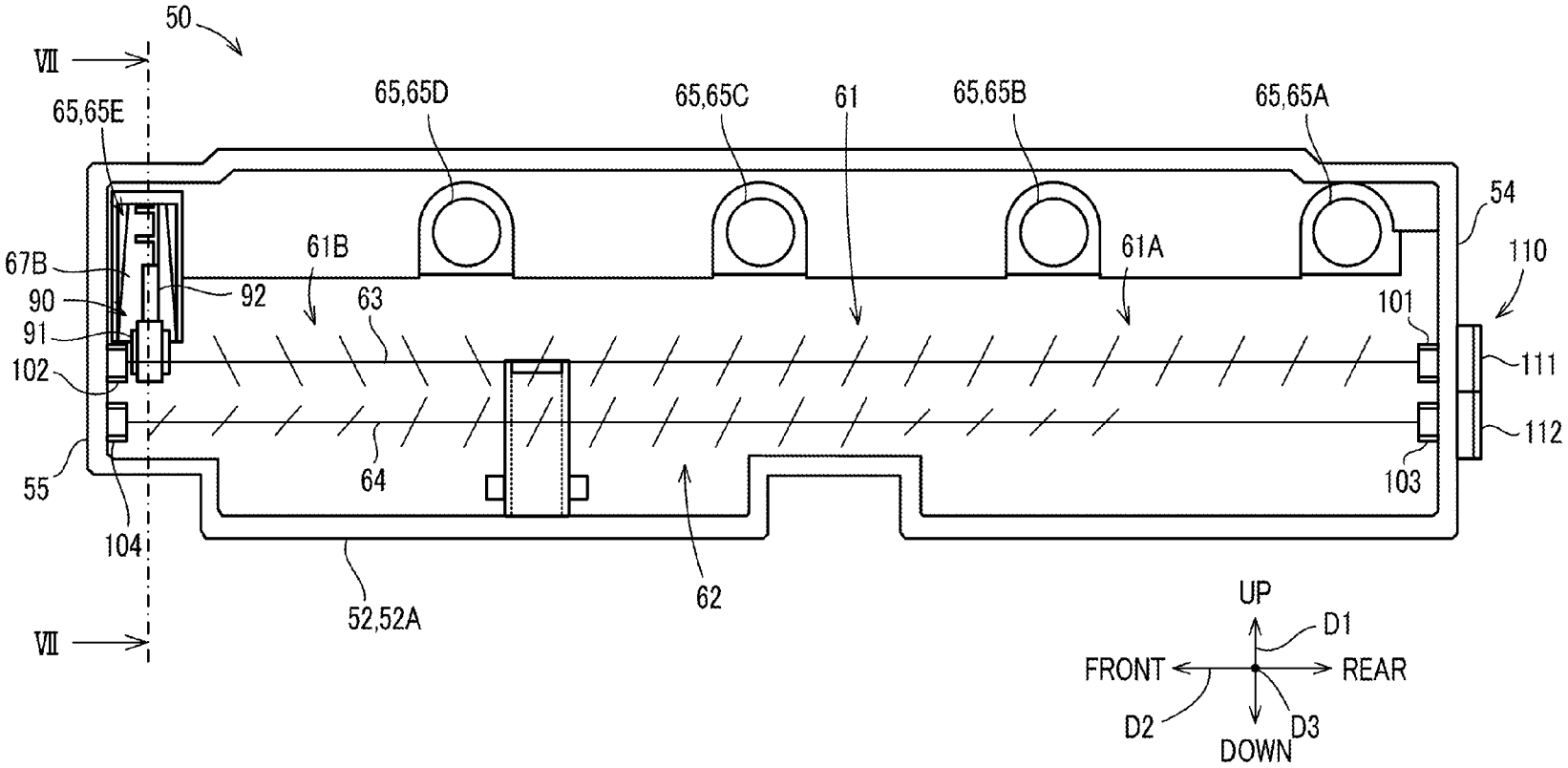
FIG. 6 is a diagram showing an internal configuration of the waste toner storing container of FIG. 5.

As shown in FIG. 5 and FIG. 6, the waste toner storing container 50 includes the container main body 52, an upper conveyance screw 61 (an example of the conveyance portion of the present disclosure), a lower conveyance screw 62, and a moving mechanism 90. Here, FIG. 5 is a perspective view of the waste toner storing container 50 viewed from the right side. FIG. 6 is a side view of the waste toner storing container 50 viewed from the right side. It is noted that in FIG. 5 and FIG. 6, a cover portion that constitutes a part of the container main body 52 is omitted for the sake of convenience in explanation.

The container main body 52 includes a main body case 52A and the cover portion (not shown). The container main body 52 is long in the front-rear direction D2. The main body case 52A constitutes a left part of the container main body 52 (the image forming portions 3 side), and the cover portion constitutes a right part of the container main body 52. With the cover portion attached to the right side of the container main body 52, the container main body 52 including a storage space in an inside thereof is formed.

The waste toner discharged from the drum cleaning devices 15 and the belt cleaning device 16 is stored in the container main body 52. Specifically, as shown in FIG. 5, five reception ports 65 (65A-65E) are provided in the left side of the main body case 52A, and the waste toner flows in from the reception ports 65.

As shown in FIG. 5, four reception ports 65 (65A-65D) having the same shape are provided in the left side of the main body case 52A. The reception ports 65A-65D are provided at equal intervals in the front-rear direction D2, and disposed at approximately the same height position. The reception port 65A is positioned in the most rear side. The reception port 65A is disposed at a position corresponding to the image forming portion 3A that forms a black toner image, and is connected to the discharge port 45 of the drum cleaning device 15 of the image forming portion 3A. That is, the black waste toner that has been removed from the photoconductor drum 11 and discharged by the drum cleaning device 15 of the image forming portion 3A flows into the container main body 52 from the reception port 65A. Similarly, the reception port 65B is disposed at a position corresponding to the image forming portion 3B that forms a yellow toner image. The reception port 65C is disposed at a position corresponding to the image forming portion 3C that forms a cyan toner image. The reception port 65D is disposed at a position corresponding to the image forming portion 3D that forms a magenta toner image. The reception ports 65A-65D are respectively formed at the tips of cylindrical portions 66 that project leftward from the left side of the main body case 52A. The cylindrical portions 66 play a role of conveyance paths that guide the waste toner having entered the reception ports 65A-65D to an inside of the container main body 52.

In the container main body 52, a guide portion 67 (an example of the conveyance guide portion of the present disclosure) is provided. The guide portion 67 is provided in the most front side of the left side of the main body case 52A. The guide portion 67 is projecting leftward from the left side and includes an upper wall 67A whose upper surface is horizontally flat. The reception port 65E is formed in the most front side of the left side of the main body case 52A. Specifically, the reception port 65E is formed in an end portion of the upper wall 67A of the guide portion 67, at the tip of the projection. The reception port 65E is an opening that is opened upward. The inside of the guide portion 67 is hollow and the reception port 65E is communicated with the inside of the container main body 52. The bottom surface of the guide portion 67 is an inclined surface 67B (an example of the inclined guide surface of the present disclosure) that is inclined diagonally downward from the reception port 65E toward the inside of the container main body 52. The reception port 65E is formed at a position that corresponds to the belt cleaning device 16. Specifically, the reception port 65E is formed at a position where it can be connected to the discharge port 27 of the toner box 26. The discharge port 27 and the reception port 65E may be directly connected to each other or indirectly connected via a conveyance guide member (not shown) or the like. Accordingly, the waste toner that is discharged from the discharge port 27 flows into the reception port 65E. As a result, the waste toner that has been removed from the intermediate transfer belt 4A and discharged by the belt cleaning device 16 enters the reception port 65E, passes through the inside of the guide portion 67, and moves diagonally downward along the inclined surface 67B. That is, the waste toner moves downward and flows into the storage space of the container main body 52 in such a manner that the waste toner is guided by the inclined surface 67B.

To solve the uneven bulk of the waste toner in the container main body 52 caused by the deviation in the inflow amount, the upper conveyance screw 61 is provided in the container main body 52, and the lower conveyance screw 62 is further provided below the upper conveyance screw 61. The upper conveyance screw 61 and the lower conveyance screw 62 are rotatably provided in the container main body 52.

The upper conveyance screw 61 is rotatably provided in the container main body 52 at the medium in the up-down direction D1. The upper conveyance screw 61 is rotatably supported by bearings 101 and 102 in the state of passing through side walls 54 and 55 provided at opposite ends in the longitudinal direction and being suspended between the side walls 54 and 55. The upper conveyance screw 61 is rotationally driven by a driving motor (not shown) via a drive transmission mechanism 110 that is described below. By being rotated, the upper conveyance screw 61 conveys the waste toner in the container main body 52 in a direction along the rotation axis line.

In the present embodiment, the upper conveyance screw 61 includes a rear-side conveyance portion 61A and a front-side conveyance portion 61B. In the upper conveyance screw 61, the rear-side conveyance portion 61A and the front-side conveyance portion 61B are disposed on the same axis. That is, the rear-side conveyance portion 61A is positioned in rear of the front-side conveyance portion 61B. The rear-side conveyance portion 61A, by being rotated, conveys the waste toner frontward along the rotation axis line. In addition, the front-side conveyance portion 61B is provided in the front side of the upper conveyance screw 61. That is, the front-side conveyance portion 61B is adjacent to the front portion of the rear-side conveyance portion 61A in the direction along the rotation axis line. The front-side conveyance portion 61B, by being rotated, conveys the waste toner rearward along the rotation axis line. The conveyance of the waste toner is realized by the helical blades formed on the upper conveyance screw 61. In the present embodiment, the blades of the rear-side conveyance portion 61A are formed at an angle that is different from an angle at which the blades of the front-side conveyance portion 61B are formed. With this configuration, when the upper conveyance screw 61 is rotated, the rear-side conveyance portion 61A and the front-side conveyance portion 61B convey the waste toner in different directions (opposite directions).

It is noted that although the present embodiment describes the configuration where the upper conveyance screw 61 includes the rear-side conveyance portion 61A and the front-side conveyance portion 61B, the upper conveyance screw 61 may not include the front-side conveyance portion 61B. That is, the upper conveyance screw 61 may include only the rear-side conveyance portion 61A.

The lower conveyance screw 62 is rotatably provided in the lower side of the container main body 52 in the up-down direction D1. Specifically, the lower conveyance screw 62 is provided below and parallel to the upper conveyance screw 61. The lower conveyance screw 62 is rotatably supported by bearings 103 and 104 in the state of passing through side walls 54 and 55 provided at opposite ends in the longitudinal direction and being suspended between the side walls 54 and 55. The lower conveyance screw 62 is rotationally driven by a driving motor (not shown) via the drive transmission mechanism 110 that is described below. By being rotated, the lower conveyance screw 62 conveys the waste toner in the bottom side of the container main body 52 rearward along the rotation axis line. The lower conveyance screw 62 is rotated such that the waste toner that has flowed in from the reception port 65E is conveyed rearward so as to be separated from the reception port 65E.

In the present embodiment, the conveyance force of the upper conveyance screw 61 for conveying waste toner is set to be larger than the conveyance force of the lower conveyance screw 62. Specifically, the conveyance force may be made different between the upper conveyance screw 61 and the lower conveyance screw 62 by making the blades thereof different in size or inclination angle. Alternatively, the rotation speed may be made different between the upper conveyance screw 61 and the lower conveyance screw 62. It is noted that the conveyance force may be represented by an amount of waste toner moving per unit time (an amount of conveyance).

The side wall 54 is provided with a drive transmission mechanism 110. The drive transmission mechanism 110 includes a gear 111 and a gear 112. The gear 111 is connected to an end portion of a rotation shaft 63 of the upper conveyance screw 61 that has passed through the side wall 54 to the outside, and is provided on the same axis as the upper conveyance screw 61. The gear 112 is connected to an end portion of a rotation shaft 64 of the lower conveyance screw 62 that has passed through the side wall 54 to the outside, and is provided on the same axis as the lower conveyance screw 62. The gear 111 and the gear 112 mesh with each other. The gear 111 is connected to the driving motor via an idle gear such that the drive can be transmitted. When a rotation driving force of the driving motor is transmitted to the drive transmission mechanism 110, the gear 111 is rotated in a direction of the arrow 71, and the upper conveyance screw 61 is rotated in the same direction. This allows the rear-side conveyance portion 61A to convey the waste toner frontward and the front-side conveyance portion 61B to convey the waste toner rearward. On the other hand, the gear 112 is rotated in a direction (indicated by the arrow 72) opposite to the rotation direction of the gear 111, and the lower conveyance screw 62 is rotated in the same direction. With this configuration, the lower conveyance screw 62 can convey the waste toner to the rear side.

Meanwhile, in a process of being conveyed to the storage space of the container main body 52 via the guide portion 67, the waste toner may stagnate halfway through the guide portion 67. In the present embodiment, to solve the stagnation, the container main body 52 is provided with the moving mechanism 90 that includes a moving member 92 that is described below.

The moving mechanism 90 includes an eccentric shaft 91 (an example of the conversion portion of the present disclosure) and the moving member 92.

As shown in FIG. 5 and FIG. 6, the eccentric shaft 91 is provided on the rotation shaft 63 of the upper conveyance screw 61 and configured to convert a rotational motion of the rotation shaft 63 to a reciprocating motion in conjunction with the rotation of the rotation shaft 63. The eccentric shaft 91 is integrally formed with the rotation shaft 63 on the front end of the rotation shaft 63. The axis of the eccentric shaft 91 is deviated from the center position of the rotation shaft 63. As a result, when the rotation shaft 63 is rotated upon input of a rotation driving force, the eccentric shaft 91 pivots around the rotation shaft 63 in conjunction with the rotation. In the present embodiment, the eccentric shaft 91 is a cylindrical member formed to be larger in size than the outer diameter of the rotation shaft 63, and is integrally formed with the rotation shaft 63 in the state where its center is separated from the center of the rotation shaft 63 in a direction vertical to the axis. One end part of the moving member 92 is connected to the eccentric shaft 91. As described above, when the eccentric shaft 91 pivots around the rotation shaft 63, the moving member 92 reciprocally moves. The eccentric shaft 91 is not limited to a cylindrical member such as the one described above, but may be any member whose axis is deviated from the center position of the rotation shaft 63, and may be configured like a crank pin of a crank shaft. The eccentric shaft 91 may be a member that has at least a configuration for converting the rotational motion of the rotation shaft 63 to a reciprocating motion.

Figure 7:
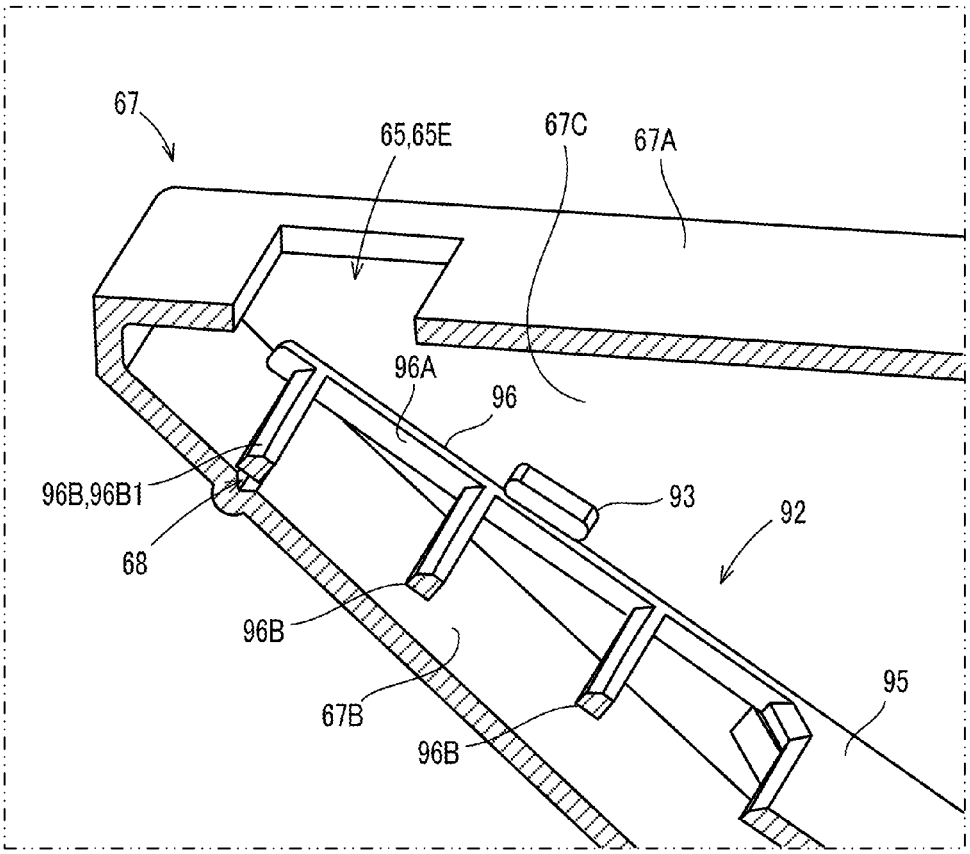
FIG. 7 is a cross-sectional diagram taken along a cut plane VII-VII shown in FIG. 5 and FIG. 6.

FIG. 7 and FIG. 8 show the moving member 92. The one end part of the moving member 92 is connected to the eccentric shaft 91, and the moving member 92 is caused to reciprocally move in a direction along the inclined surface 67B of the guide portion 67 by a force of the reciprocating motion received from the eccentric shaft 91. The moving member 92 includes a connection portion 94, a base portion 95, and an arm portion 96, wherein the connection portion 94 is fitted on the eccentric shaft 91, the base portion 95 is plate-like and extends from the connection portion 94 toward the reception port 65E through the guide portion 67, and the arm portion 96 further extends from the base portion 95 toward the reception port 65E. The moving member 92 is a resin member made of synthetic resin, and the connection portion 94, the base portion 95, and the arm portion 96 are integrally formed as the moving member 92. The arm portion 96 includes a rod-like member 96A and three comb-tooth portions 96B, wherein the rod-like member 96A is extending toward the reception port 65E from an extension end of the base portion 95, and the comb-tooth portions 96B are disposed in the rod-like member 96A in a comb-teeth state. Among the comb-tooth portions 96B, a comb-tooth portion 96B1 that is positioned in the most extension end side of the rod-like member 96A, comes into contact with the inclined surface 67B by its own weight if there is no interposition, such as the waste toner in the guide portion 67, therebetween. That is, the comb-tooth portion 96B1 comes into contact with the inclined surface 67B by its own weight in the state where waste toner is not present in the guide portion 67. As shown in FIG. 7, a recess portion 68 is formed on the inclined surface 67B. The recess portion 68 is provided at a position where it contacts the comb-tooth portion 96B1 when the moving member 92 reciprocally moves. With this configuration, when the moving member 92 reciprocally moves along the inclined surface 67B, the comb-tooth portion 96B1 contacts the recess portion 68 and generates a vibration. The vibration allows the waste toner that has stagnated on the inclined surface 67B to be conveyed smoothly to the inside of the container main body 52. It is noted that the number of the comb-tooth portions 96B is not limited to three, but may be any number as far as a plurality of comb-tooth portions 96B are disposed in the rod-like member 96A.

When the rotation shaft 63 is rotated, the eccentric shaft 91 pivots, and the rotational motion of the rotation shaft 63 is converted to the reciprocating motion by the eccentric shaft 91. At this time, the reciprocating motion is transmitted from the connection portion 94 to the moving member 92, the moving member 92 reciprocally moves in a direction along the inclined surface 67B. As a result, even in the case where the waste toner has stagnated in the guide portion 67, the waste toner is scraped off and stirred by the moving member 92 that is reciprocally moving, and moves downward along the inclined surface 67B.

However, there is a case where the waste toner that has stagnated on the inclined surface 67B cannot be scraped off sufficiently. For example, if the waste toner enters a gap that is generated between the moving member 92 and the inclined surface 67B during pivoting of the eccentric shaft 91, the waste toner becomes difficult to be scraped off, and the waste toner will aggregate and adhere to the inclined surface 67B of the guide portion 67, and the aggregation will grow with time. In such a case, it becomes difficult to scrape off the waste toner. In addition, the moving member 92 is a resin product as describe above, and is as small as can be disposed in a narrow space of the guide portion 67. Thus its weight is light. As a result, when a large amount of waste toner is discharged, the moving member 92 can only reciprocally move on an upper surface layer of the waste toner on the inclined surface 67B, without being able to scrape off the waste toner sufficiently. In the present embodiment, to solve such a malfunction, a restriction member 93 is provided in the container main body 52.

The restriction member 93 is provided in the guide portion 67. The restriction member 93 presses the moving member 92 toward the inclined surface 67B in such a manner that the extension end part of the moving member 92 abuts on the inclined surface 67B. In other words, the restriction member 93 restricts the moving member 92 from being displaced upward such that the comb-tooth portion 96B1 of the moving member 92 is not separated from the inclined surface 67B. In the present embodiment, as shown in FIG. 7, the guide portion 67 includes a side wall 67C that extends upward from the inclined surface 67B. The restriction member 93 is a protruding member provided on an inner surface of the side wall 67C. The restriction member 93 is protruding vertically from the inner surface of the side wall 67C, and is formed in the shape of a rib that extends approximately parallel to the inclined surface 67B. It is noted that the restriction member 93 is not limited to a rib-like member, but may be, for example, a cylindrical projection.

Figure 8A:
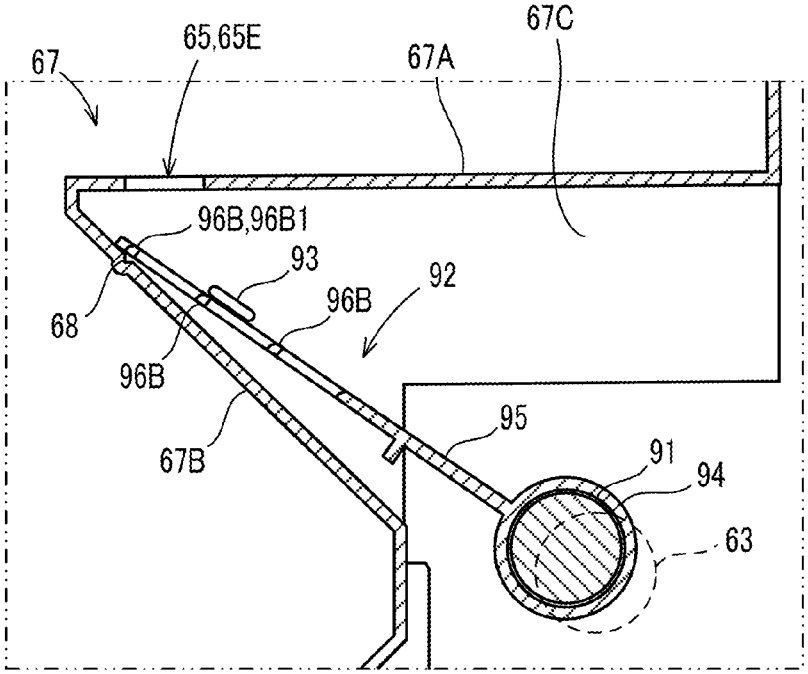
FIG. 8A and FIG. 8B are diagrams showing states where the waste toner is stored in the waste toner storing container according to an embodiment of the present disclosure.
Figure 8B:
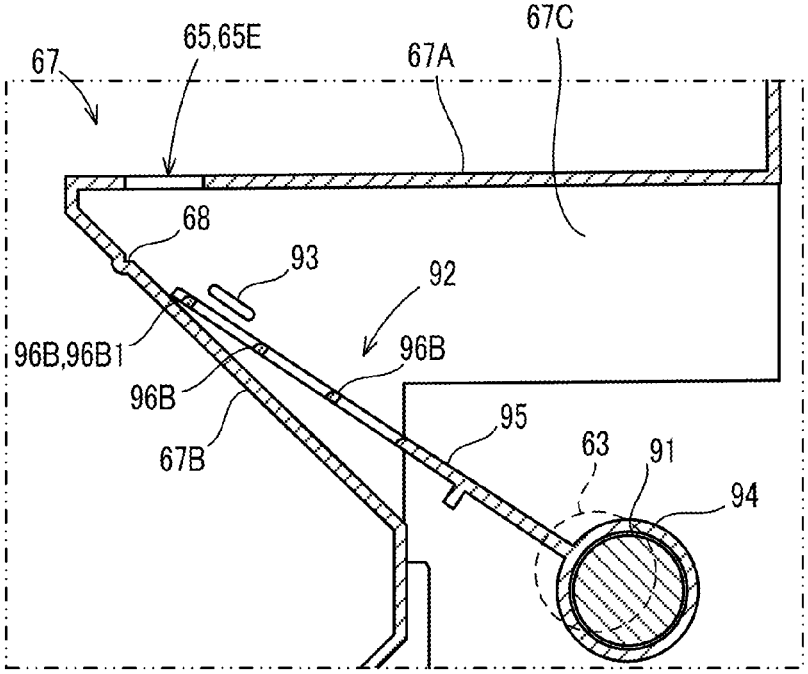

As shown in FIG. 8, in the state (the state shown in FIG. 8A) where the eccentric shaft 91 has pivoted to be closest to the reception port 65E, the restriction member 93 abuts on an upper end part of the arm portion 96 of the moving member 92 in such a way as to restrict the moving member 92 downward (namely, restrict it from being displaced upward). It is noted that in the state (the state shown in FIG. 8B) where the eccentric shaft 91 has pivoted to be farthest from the reception port 65E, the moving member 92 is not restricted by the restriction member 93.

Since the restriction member 93 is disposed at the above-described position, during a process in which the moving member 92 reciprocally moves, the comb-tooth portion 96B1 abuts on the inclined surface 67B due to the restriction by the restriction member 93. In addition, since the moving member 92 is periodically restricted by the restriction member 93 as it reciprocally moves, the comb-tooth portion 96B1 periodically abuts on the inclined surface 67B even in a state where the moving member 92 reciprocally moves on an upper surface layer of the waste toner on the inclined surface 67B. This makes it possible to scrape off the waste toner in the guide portion 67 in a reliable manner and prevent an occurrence of a clogging in the guide portion 67 due to the stagnation of waste toner. This allows the waste toner that has flowed in from the reception port 65E to be guided smoothly to the storage space of the container main body 52.

It is noted that in the above-described embodiment, the moving mechanism 90 and the restriction member 93 are provided in the guide portion 67 that guides the waste toner discharged from the intermediate transfer belt 4A. However, the present disclosure is not limited to the above-described configuration. For example, the moving mechanism 90 may be applied to the cylindrical portions 66 that guide the waste toner from the photoconductor drums 11. In this case, the restriction member 93 is provided on inner walls of the cylindrical portions 66.

Figure 9:
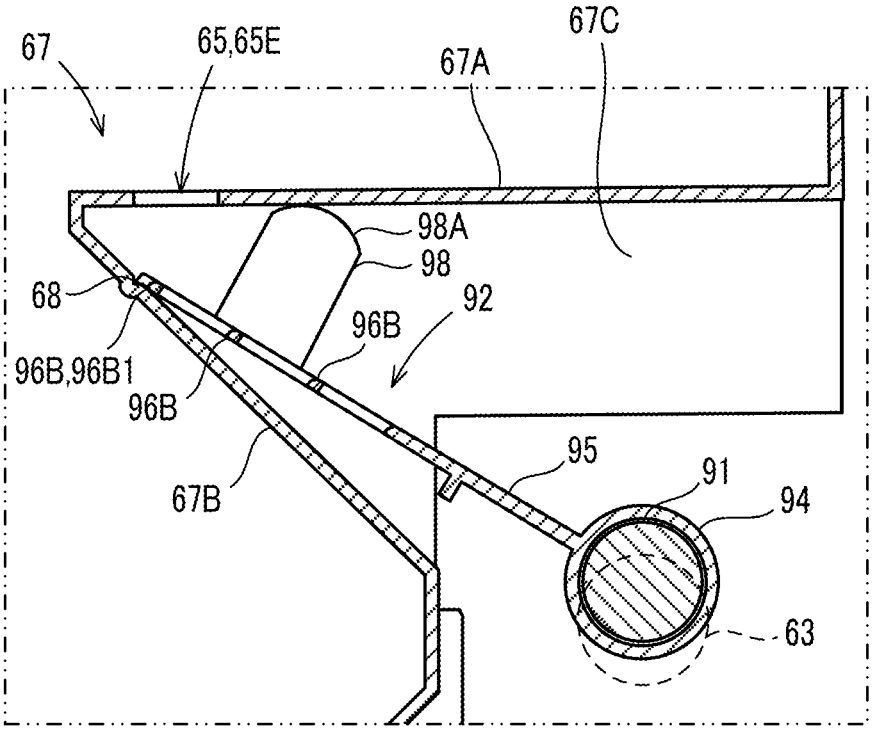
FIG. 9 is a diagram showing a modification of a restriction member according to an embodiment of the present disclosure.

It is noted that in the above-described embodiment, the restriction member 93 is provided on the side wall 67C of the guide portion 67. However, the present disclosure is not limited to the above-described restriction member 93. As shown in FIG. 9, instead of the restriction member 93, a restriction member 98 provided on the moving member 92 may be used to restrict the moving member 92 downward. Here, the restriction member 98 is provided on an upper part of the arm portion 96 of the moving member 92. More specifically, the restriction member 98 is a protruding member protruding upward from the upper part of the arm portion 96. An upper end portion 98A of the restriction member 98 is formed in the shape of an arc, and is configured to abut on a rear surface of the upper surface 67A in the state (the state shown in FIG. 9) where the eccentric shaft 91 has pivoted to be at the highest position in the vertical direction. With such a configuration of the restriction member 98, the comb-tooth portion 96B1 receives the restriction of the restriction member 98 and abuts on the inclined surface 67B as the moving member 92 reciprocally moves.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A waste toner storing container comprising:

a container main body configured to store waste toner discharged from an image-carrying member provided in an image forming apparatus;

a conveyance guide portion disposed in an upper part of the container main body and having an inclined guide surface that guides the waste toner diagonally downward from a reception port which receives the waste toner, to an inside of the container main body;

a conveyance portion rotatably provided in the inside of the container main body where the conveyance guide portion is not disposed, and configured to, by being rotated, convey the waste toner in a direction along a rotation axis line;

a conversion portion disposed on a rotation shaft of the conveyance portion and configured to convert a rotational motion of the rotation shaft to a reciprocating motion in conjunction with a rotation of the rotation shaft;

a moving member whose one end part is connected to the conversion portion and the other end part extends through the conveyance guide portion diagonally upward toward the reception port, the moving member configured to reciprocally move in a direction along the inclined guide surface by a force of the reciprocating motion received from the conversion portion; and a restriction member disposed in the conveyance guide portion and configured to restrict the moving member from being displaced upward from the inclined guide surface by pressing the moving member toward the inclined guide surface in such a manner that the other end part of the moving member abuts on the inclined guide surface.

2. The waste toner storing container according to claim 1, wherein the conveyance guide portion includes an upper wall including the reception port that is opened upward, and the restriction member is a protruding member protruding upward from an upper part of the moving member and pressing the moving member downward by abutting on an inner surface of the upper wall.

3. The waste toner storing container according to claim 1, wherein the one end part of the moving member is connected to the conversion portion, and the moving member reciprocally moves in the direction along the inclined guide surface of the conveyance guide portion by the force of the reciprocating motion received from the conversion portion.

4. The waste toner storing container according to claim 1, wherein the image-carrying member is a transfer belt configured to carry toner images of a plurality of colors that are to be transferred during an image forming process performed in the image forming apparatus, and the conveyance guide portion is disposed at one end of the container main body in the direction along the rotation axis line, receives waste toner from the transfer belt, and guides the waste toner to the inside of the container main body.

5. The waste toner storing container according to claim 2, wherein an upper end part of the restriction member is formed in a shape of an arc, and is configured to abut on an inner surface of the upper wall in a state where the conversion portion is at a highest position in a vertical direction.

6. The waste toner storing container according to claim 3, wherein the conversion portion is an eccentric shaft provided on the rotation shaft of the conveyance portion, and an axis of the eccentric shaft is deviated from a center position of the rotation shaft, and the moving member includes a connection portion, a base portion, and an arm portion, the connection portion being fitted on the eccentric shaft, the base portion being plate-like and extending through the conveyance guide portion toward the reception port, and the arm portion further extending from the base portion toward the reception port.

7. The waste toner storing container according to claim 6, wherein the moving member is a resin member made of synthetic resin, and the connection portion, the base portion, and the arm portion are integrally formed as the moving member.

8. The waste toner storing container according to claim 6, wherein the arm portion includes a rod-like member and a plurality of comb-tooth portions, the rod-like member extending toward the reception port from an extension end of the base portion, and the comb-tooth portions being disposed in the rod-like member.

9. The waste toner storing container according to claim 8, wherein among the plurality of comb-tooth portions, a comb-tooth portion that is positioned in a most extension end side of the rod-like member comes into contact with the inclined guide surface by its own weight in a state where waste toner is not present in the conveyance guide portion.

10. The waste toner storing container according to claim 9, wherein the comb-tooth portion that is positioned in the most extension end side of the rod-like member contacts a recess portion that is formed on the inclined guide surface.

11. A waste toner storing container comprising:

a container main body configured to store waste toner discharged from an image-carrying member provided in an image forming apparatus;

a conveyance guide portion disposed in the container main body and having an inclined guide surface that guides the waste toner diagonally downward from a reception port which receives the waste toner, to an inside of the container main body;

a conveyance portion rotatably provided in the inside of the container main body and configured to, by being rotated, convey the waste toner in a direction along a rotation axis line;

a conversion portion disposed on a rotation shaft of the conveyance portion and configured to convert a rotational motion of the rotation shaft to a reciprocating motion in conjunction with a rotation of the rotation shaft;

a moving member whose one end part is connected to the conversion portion and the other end part extends through the conveyance guide portion toward the reception port, the moving member configured to reciprocally move in a direction along the inclined guide surface by a force of the reciprocating motion received from the conversion portion; and a restriction member configured to restrict the moving member from being displaced upward from the inclined guide surface by pressing the moving member toward the inclined guide surface in such a manner that the other end part of the moving member abuts on the inclined guide surface, wherein the conveyance guide portion includes a side wall that extends upward from the inclined guide surface, and the restriction member is a protruding member that is provided on the side wall and presses the moving member toward the inclined guide surface by abutting on an upper end part of the other end part of the moving member.

12. An image forming apparatus comprising:

the waste toner storing container according to claim 1;

an image-carrying member configured to carry a toner image; and a waste toner removing portion configured to remove waste toner from a surface of the image-carrying member and discharge the removed waste toner to the waste toner storing container.

* * * * *